United States Patent [19]

Kelley et al.

[11] Patent Number: 4,521,278

[45] Date of Patent: Jun. 4, 1985

[54] METHOD FOR PRODUCING NEEDLE COKE

[75] Inventors: Arnold E. Kelley, Orange; Michael J. Block; Milan R. Skripek, both of Fullerton, all of Calif.

[73] Assignee: Union Oil Company of California, Los Angeles, Calif.

[21] Appl. No.: 488,731

[22] Filed: Apr. 26, 1983

[51] Int. Cl.[3] ..... C10B 49/06

[52] U.S. Cl. ..... 201/17; 201/34; 201/44; 208/131; 423/449

[58] Field of Search ..... 201/17, 25, 34, 44; 208/131; 423/448, 449, 461

[56] References Cited

U.S. PATENT DOCUMENTS

| | | | |
|---|---|---|---|
| 2,775,549 | 12/1956 | Shea | 208/131 |
| 2,910,411 | 10/1959 | Offutt . . | |
| 3,284,317 | 11/1966 | Jahnig et al. | 201/17 |
| 3,369,871 | 2/1968 | Hardy et al. . | |
| 3,677,533 | 7/1972 | Olover et al. . | |
| 3,704,224 | 11/1972 | Scovill et al. | 201/17 |
| 3,759,795 | 9/1973 | Oliver et al. | 201/25 |
| 3,823,073 | 7/1974 | Minkkinen . | |
| 4,075,084 | 2/1978 | Skripek et al. | 208/131 |
| 4,100,265 | 7/1978 | Yoshimura et al. | 201/17 |
| 4,160,814 | 7/1979 | Hardin et al. | 201/17 |
| 4,169,767 | 10/1979 | Noguchi et al. | 201/27 |
| 4,176,010 | 11/1979 | Dudek et al. | 423/461 |
| 4,265,710 | 5/1981 | Noguchi et al. | 201/27 |

FOREIGN PATENT DOCUMENTS

| | | |
|---|---|---|
| 52-29801 | 3/1977 | Japan . |
| 2093059 | 8/1982 | United Kingdom . |

OTHER PUBLICATIONS

"Production of Calcined Coke with Lower Thermal Expansion Coefficient under the New Processing Technology", KOA Oil Company, Limited, dated Apr., 1979, (28 pages), (13 pages).

"Structural Changes Accompanying Coke Calcination", Mack P. Whittaker, Fred C. Miller, and Harlan C. Fritz, *Industrial and Engineering Chemistry Product Research and Development,* vol. 9, No. 2, 1970, pp. 187–190.

*Primary Examiner*—Peter Kratz

*Attorney, Agent, or Firm*—Dean Sandford; Denton L. Anderson; Yale S. Finkle

[57] ABSTRACT

A method is provided for producing needle coke comprising the steps of heating green needle coke at temperatures between about 875° F. and about 1,200° F. for between about 10 minutes and about 24 hours, and, without first allowing the temperature of the coke to cool below about 250° F., calcining the green needle coke at calcination temperatures above about 2,000° F.

34 Claims, 1 Drawing Figure

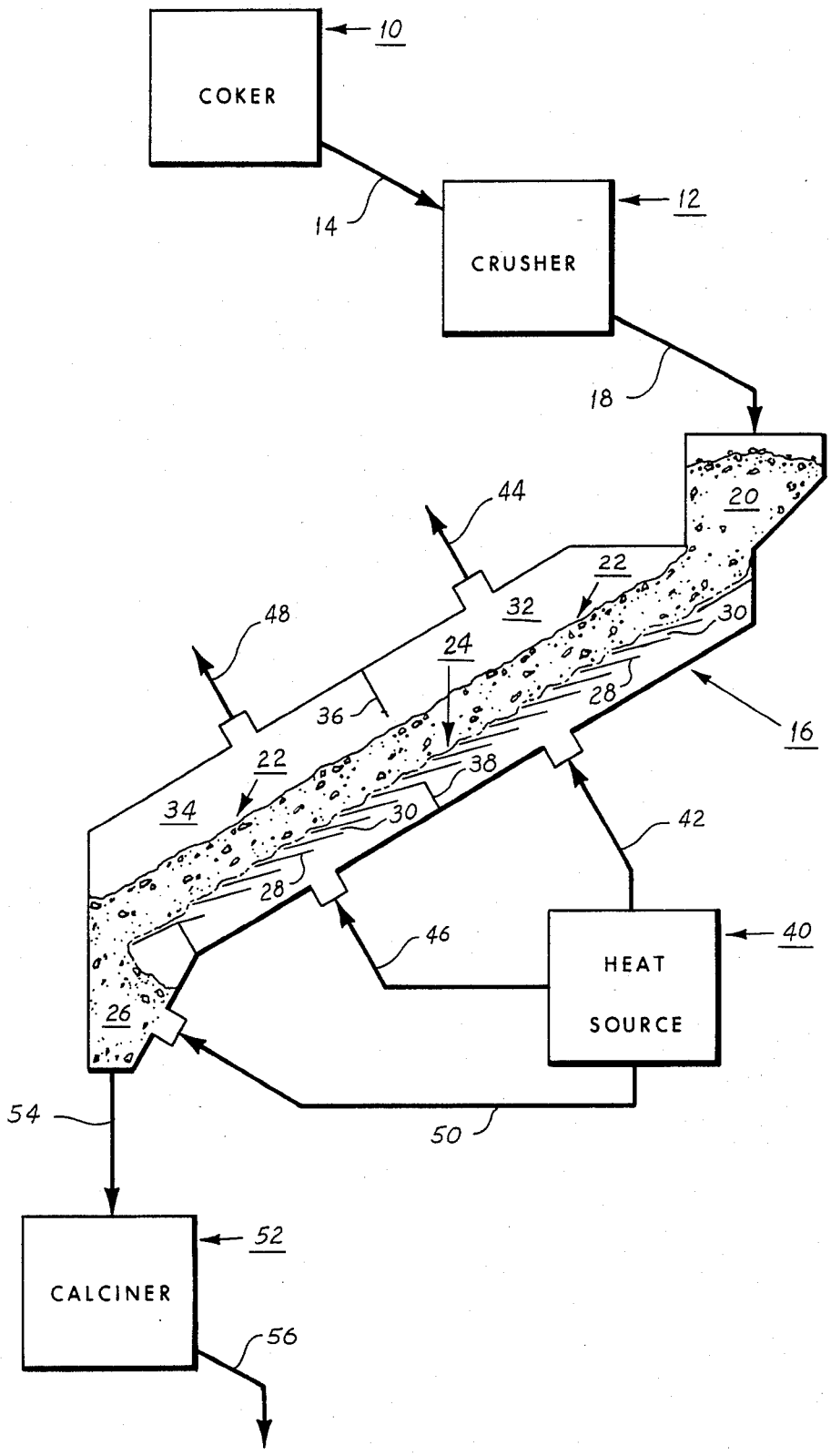
COKER
10
14
CRUSHER
12
18
20
44
22
32
30
48
24
28
36
16
22
38
34
30
42
28
46
HEAT
SOURCE
40
26
54
50
CALCINER
52
56

METHOD FOR PRODUCING NEEDLE COKE

BACKGROUND

This invention relates generally to a process for producing coke, and particularly to a process for producing premium-grade needle coke.

Needle coke such as that described in U.S. Pat. No. 2,775,549 is in high demand, principally as a raw material for graphite electrodes used in the steel industry. Premium grade needle coke, which is differentiated over common grade needle coke by a higher bulk density and a lower coefficient of thermal expansion (CTE) of its graphitized product, is in especially high demand. High bulk density and low graphitized product CTE are necessary characteristics of needle cokes used in the manufacture of heavy duty graphite electrodes capable of conducting large electrical currents at high temperatures.

Needle coke is traditionally manufactured in two steps. First, green (uncalcined) needle coke is prepared from petroleum residuum by a specialize delayed coking process such as that disclosed in U.S. Pat. No. 4,075,084. The green needle coke is then calcined at temperatures between about 2,000° F. and 3,000° F. to yield the final needle coke product.

A persistent problem with traditional needle coke manufacturing methods is their tendency to produce a large percentage of coke fines (i.e. coke particles which are sufficiently small to pass through a screen of about a No. 6 mesh). A needle coke with a preponderance of fines is unsuitable for electrode manufacture and is, therefore, much less valuable than a needle coke with a preponderance of larger particles. Thus, to the needle coke manufacturer, a large fines production means a substantial loss in revenue.

Needle coke fines can be produced in the manufacture of needle coke by several mechanisms. For many manufacturers, the predominant mechanism is the degradation of green needle coke particles during calcination. Green needle coke is considerably more friable than calcined needle coke. During the early stages of calcination, the mechanical agitation of the calcining apparatus (usually a rotary kiln) crumbles much of the green coke into tiny fragments. For those manufacturing processes which produce a highly friable green needle coke, fines production during calcination is often very large.

A need exists, therefore, for a needle coke manufacturing method which produces needle coke without producing an inordinate quantity of fines.

Consequently, an object of the invention is to provide a superior method for producing needle coke while producing fewer fines.

A further object of the invention is to provide a superior method for producing premium-grade needle coke from a highly friable green needle coke.

A still further object of the invention is to provide a superior method for reducing the friability of green needle coke.

A still further object of the invention is to provide a superior method for treating green needle coke so as to produce calcined needle coke having a bulk density which is greater than that of calcined needle coke produced by conventional treating methods.

A still further object of the invention is to provide a superior method for treating green needle coke so as to produce calcined needle coke having, when graphitized, a coefficient of thermal expansion which is less than that of calcined and graphitized needle coke produced by conventional treating methods.

These and other objects and advantages of the invention will become apparent to those skilled in the relevant art in view of the following description of the invention.

SUMMARY OF THE INVENTION

It has been discovered that green needle cokes, and especially highly friable green needle cokes, can be made markedly less friable by being heated at temperatures between about 875° F. and about 1,200° F. Accordingly, the present invention provides a method for making needle coke comprising the steps of heating green needle coke at temperatures between about 875° F. and about 1,200° F. for between about 10 minutes and about 24 hours, and, without first allowing the temperature of the coke to cool below about 250° F., calcining the green needle coke at calcination temperatures above about 2,000° F.

The invention markedly decreases the friability of green needle coke which, in turn, markedly decreases the quantity of fines produced during calcining. The invention has, in many instances, also been found to increase the bulk density of the needle coke product and to decrease the CTE of graphite produced from the needle coke product. Thus, the invention not only produces a superior yield of needle coke but can often produce a superior grade of needle coke as well.

BRIEF DESCRIPTION OF THE DRAWING

The present invention will be more readily understood by reference to the drawing which schematically illustrates the preferred embodiment of the invention.

DETAILED DESCRIPTION OF THE INVENTION

Referring to the drawing, green needle coke is prepared in coker 10 via a suitable method such as that described in U.S. Pat. No. 4,075,084, the disclosure of which is incorporated herein by reference, in its entirety. Preferably, the green needle coke contains less than about 1 weight percent sulfur and is manufactured from an aromatic mineral oil feedstock having an API gravity between about −6° and +15° boiling predominantly above about 600° F. and containing about 6.5 to 9 weight percent hydrogen and more than about 0.7 weight percent sulfur. Preferably, the manufacturing process comprises: (1) fractionally distilling the feedstock so as to separate a major overhead fraction from a minor bottoms fraction, any asphaltenes present in said feedstock being concentrated in the bottoms fraction; (2) subjecting the overhead fraction to catalytic hydrofining at a temperature correlated with hydrogen pressure and space velocity so as to effect at least about 50 percent desulfurization of the overhead fraction without raising the hydrogen content of the 500° F.+ hydrofiner effluent above about 10.5 weight percent; (3) recovering a heavy hydrofined fraction boiling predominantly above 600° F. from the aforementioned hydrofining step and blending that heavy hydrofined fraction with at least a portion of the aforementioned minor bottoms fraction so as to form a coking feedstock containing less than about 5 weight percent asphaltenes; and (4) subjecting the coking feedstock to delayed thermal coking at a temperature correlated with pressure so as to give a needle coke and a coker distillate.

Typically, green needle coke is relatively friable, having a Hardgrove Grindability Index value above about 90 as measured by ASTM standard test method D 409-51 (modified by commencing the test method with a random selection of ½ to ¾ inch particles of needle coke rather than commencing with a representative sample of coal prepared by ASTM method D 492) ASTM standard test method D 409-51 is incorporated herein by reference, in its entirety. The present invention is especially directed to the treatment of highly friable green needle cokes having a Hardgrove Grindability Index value above about 120, and even more especially to green needle cokes having a Hardgrove Grindability Index above 135.

The green needle coke particles are transferred from coker 10 to crusher 12 via transfer means 14. In crusher 12, the green needle coke particles are physically reduced in size to particles having a maximum diameter which is typically less than about 6 inches, preferably less than about 4 inches and most preferably between about ¼ and about 4 inches.

From crusher 12, the crushed green coke is transferred to precalciner 16 via transfer means 18. Preferably, precalciner 16 is configured to receive, uniformly heat and discharge the green needle coke particles without causing undue attrition of the particles. Most preferably, precalciner 16 is a declined bed-type heater such as the Sliding Bed TM preheaters manufactured by Midland-Ross Corporation of Toledo, Ohio.

The coke enters precalciner 16 and accumulates within feed hopper chamber 20. From feed hopper chamber 20, the coke gravitates as moving coke bed 22 along declined bed support 24 and into residence chamber 26.

Bed support 24 is declined from the horizontal at an angle which is preferably greater than the angle of repose for the gravitating coke bed but less than the coke bed's angle of slide. Most preferably, the angle of declination is chosen so as to cause the coke bed to slide down bed support 24 in a substantially "plug-flow" manner. A typical angle of declination is between about 25 and about 35 degrees from the horizontal.

Bed support 24 is configured so as to form a substantially smooth surface over which the coke bed gravitates. Bed support 24 is further configured with a plurality of openings which allow the passage of gases across the cross-section of the surface while substantially preventing the counter-current passage of solids.

In the preferred embodiment of the invention illustrated in the drawing, bed support 24 is comprised of a plurality of equidimensional, rectangular surfaces 28, each characterized by a long leading edge, a long trailing edge and two short edges. Surfaces 28 are arranged so that all long edges are parallel to the horizontal plane and so that all short edges are aligned along a single family of parallel lines, each line of which is declined from the horizontal by an angle which is slightly less than the net angle of decline for bed support 24 as a whole. Surfaces 28 are also arranged at decreasing elevations such that the leading long edge of each (except the lowermost) overlaps but does not touch the trailing long edge of the surface immediately below it. Gaps 30, formed by the spaces between the adjoining pairs of surfaces, are typically uniform and sized so as to allow the downward passage of gases therethrough without allowing the upward flow of solids.

Hot gases are caused to flow from beneath surfaces 28, through gaps 30 and through gravitating coke bed 22. In so doing, coke bed 22 is heated to between about 875° F. and about 1,200° F. Preferably, coke bed 22 is so heated in two stages. In the first stage, the coke particles are gently dried of substantially all absorbed moisture by being heated at modest temperatures. In the second stage, the dry coke particles are then heated to between about 875° F. and about 1,200° F. By heating the coke in two stages, coke particle attrition caused by the rapid vaporization of absorbed moisture is minimized.

Accordingly, in the preferred embodiment illustrated in the drawing, precalciner 16 is divided into drying section 32 and heat treating section 34 by transverse baffles 36 and 38 positioned above and below bed 22, respectively. Warm drying gases from heat source 40, typically at temperatures between about 250° F. and about 850° F., preferably between about 300° F. and about 500° F. and most preferably between about 400° F. and about 450° F., are caused to flow into drying section 32 via conduit 42. Within drying section 32, the drying gases flow through gaps 30 and permeate bed 22, thereby raising the temperature within bed 22 to between about 220° F. and about 600° F., preferably between about 250° F. and about 450° F. and most preferably between about 280° F. and about 350° F. The drying gases then flow out of drying section 32 via conduit 44, are treated to remove contaminants, if necessary, and are recycled or discharged to the atmosphere.

In like fashion, hot gases from heat source 40, at a temperature between about 875° F. and about 1,950° F., preferably between 1,000° F. and about 1,500° F. and most preferably between about 1,100° F. and about 1,300° F., are caused to flow into heat treating section 34 via conduit 46. Within heat treating section 34, these hot gases flow through gaps 30 and permeate bed 22, thereby further raising the temperature within bed 22 to between about 875° F. and about 1,200° F., preferably between about 925° F. and about 1,100° F. and most preferably between about 950° F. and about 1,050° F. The hot gases then flow out of heat treating section 34 via conduit 48, are treated to remove contaminants, including entrained volatile combustible material (VCM), and are recycled or discharged to the atmosphere.

Heat source 40 can be any apparatus capable of generating a steady flow of hot gases. Typically, heat source 40 comprises a combustor of hydrocarbon fuels such as a natural gas burner. Drying gases and heat treatment gases produced in heat source 40 can be any gas or gas mixture which is substantially inert to the coke particles within precalciner 16. Typically, these gases will be combustion product gases comprising nitrogen, carbon dioxide and steam. Preferably, the oxygen concentration of the drying and heat treatment gases is less than about 5 volume percent, more preferably less than about 2 volume percent and most preferably less than about 0.5 volume percent.

The flow rate of gravitating bed 22 and the dimensions of drying section 32 and heat treating section 34 are selected to yield the desired residence time of coke bed 22 within each of the two sections. The residence time is selected so as to effect at least some reduction in the friability of the green needle coke, and, for the highly friable green needle cokes in particular, the friability is reduced to a Hardgrove Grindability Index value which is preferably below about 100, more preferably below about 85 and most preferably below about 70. The optimum residence times will depend on the time-temperature profile within each section. In general, the optimum residence times are relatively longer when the coke is heated slower and/or treated to lower maximum temperatures.

The coke particle residence time within drying section 32 is preferably sufficient to dry the coke to an absorbed water content which is less than about 5.0 weight percent (dry basis), more preferably less than about 2.0 weight percent and most preferably less than about 1.0 weight percent. Typically, the residence time within drying section 32 is between about 0.2 and about 4.0 hours. When the coke is heated to an average maximum temperature within drying section 32 of between about 280° F. and about 350° F., the typical residence time within drying section 32 is between about 0.4 and about 1.5 hours. As used herein, the phrase "average maximum temperature" (AMT) refers to the average of the coke particles' individual maximum temperatures. Where coke bed 22 gravitates in a substantially "plug-flow" manner, where the heat treating gas is uniformly distributed within the bed, and where the bed temperature does not significantly vary with bed depth, the temperature of each coke particle rises uniformly to about the same maximum. The AMT can, in that case, be closely approximated by measuring the coke bed temperature at several points along the coke bed flow path and then singling out the highest of these temperatures. On the other hand, where significant variations exist with respect to the bed flow profile, the distribution of heat treating gas within the bed, and/or the temperature-coke bed depth profile, the AMT can best be approximated by obtaining a representative sample of coke particle temperatures throughout the bed and from that sample computing a weighted average of the maximum temperatures along the various bed flow paths and at the various bed depths.

When the heat-up time for the green coke within heat treating section 34 is rapid, that is, when the coke is heated from its drying section 32 exit temperature to within about 50° F. of the AMT within heat treating section 34 in less than about 30 minutes, the coke bed residence time is preferably selected from TABLE 1. For example, when the coke is heated to an AMT of about 1,000° F. after having been heated from its drying section 32 exit temperature to about 950° F. in less than about 30 minutes, the residence time at which coke bed 22 remains within the temperature range between about 950° F. and about 1,000° F. is, as shown in TABLE 1, preferably between about 0.5 and about 4 hours, more preferably between about 0.6 and about 2.0 hours and most preferably between about 0.6 and about 1.1 hours.

TABLE 1

| AMT Within Heat Treating Section 34 (°F.) | Desirable Residence Time Range for Coke Bed 22 When Within 50° F. of AMT (hours) | Preferred Residence Time Range for Coke Bed 22 When Within 50° F. of AMT (hours) | Most Preferred Residence Time Range for Coke Bed 22 When Within 50° F. of AMT (hours) |
|---|---|---|---|
| 875 to 925 | 3 to 24 | 4 to 8 | 5 to 7 |
| 925 to 975 | 1 to 6 | 1.2 to 5 | 15 to 4.5 |
| 975 to 1,025 | 0.5 to 4 | 0.6 to 2 | 0.6 to 1.1 |
| 1,025 to 1,100 | 0.3 to 3 | 0.4 to 2 | 0.4 to 1 |
| 1,100 to 1,200 | 0.2 to 1 | 0.2 to 0.8 | 0.2 to 0.5 |

When the heat-up time for the green coke is not rapid, that is, when the coke is heated from its drying section 32 exit temperature to within about 50° F. of the AMT within heat treating section 34 in greater than about 30 minutes, the heat absorbed by the coke particles during the heat-up period may significantly contribute to their heat treatment. Consequently, when the heat-up time is not rapid, the residence time for coke bed 22 as it is heated from about 50° F. of the AMT to the AMT itself is preferably selected such that:

$$0.4 < \left(\frac{t1}{6.0} + \frac{t2}{3.5} + \frac{t3}{0.8} + \frac{t4}{0.5} + \frac{t5}{0.3}\right) < 2.5$$

where t1 is the number of hours that the coke bed is maintained at temperatures between about 875° F. and about 925° F., t2 is the number of hours (if any) that the coke bed is maintained at temperatures between about 925° F. and about 975° F., t3 is the number of hours (if any) that the coke bed is maintained at temperatures between about 975° F. and about 1,025° F., t4 is the number of hours (if any) that the coke bed is maintained at temperatures between about 1,025° F. and about 1,100° F. and t5 is the number of hours (if any) that the coke bed is maintained at temperatures between about 1,100° F. and about 1,200° F.

More preferably, the residence time for coke bed 22 when within about 50° F. of the AMT within heat treating section 34 is selected such that:

$$0.6 < \left(\frac{t1}{6.0} + \frac{t2}{3.5} + \frac{t3}{0.8} + \frac{t4}{0.5} + \frac{t5}{0.3}\right) < 1.5$$

and most preferably, such residence time is selected such that:

$$0.8 < \left(\frac{t1}{6.0} + \frac{t2}{3.5} + \frac{t3}{0.8} + \frac{t4}{0.5} + \frac{t5}{0.3}\right) < 1.2$$

Coke bed 22 gravitates from surface 24 to residence chamber 26, the lowermost portion of heat treating section 34. By varying the level of coke particles within residence chamber 26, the residence time within heating section 34 can be controlled. Optionally, where additional heat input is desired within residence chamber 26, additional heat treatment gases from heat source 40 can be caused to flow into residence chamber 26 via conduit 50.

Heat treatment within precalciner 16 is preferably carried out at approximately atmospheric pressure. Precalciner 16 is configured so that the levels of coke within feed hopper chamber 20 and residence chamber 26 substantially prevent the flow of gases between precalciner 16 and the atmosphere. More preferably, a slight vacuum is maintained within precalciner 16 so as to insure against polluting the atmosphere with precalciner gases and coke dust. Most preferably, the pressure within precalciner 16 is maintained at a vacuum between about 0.1 inch and about 1.0 inches of water.

The heat treated green needle coke is removed from precalciner 16 and transferred to calciner 52 via transfer means 54. The transfer is accomplished while maintaining the coke temperature above about 250° F., preferably above about 500° F. and most preferably above about 800° F. At the time of the transfer, the heat treated green needle coke is markedly less friable than it was prior to its heat treatment within precalciner 16.

Calciner 52 is comprised of suitable conventional equipment capable of heating the green needle coke to temperatures above 2,000° F., typically between about 2,400° F. and about 3,000° F. A common example of such equipment is a rotary kiln. Following calcination, the resultant premium-grade needle coke product is removed from calciner 52 and transferred to a storage site (not shown) via transfer means 56. The proportion of fines in the needle coke product is markedly less than in needle cokes prepared by a comparable conventional procedure wherein an identical needle coke feedstock is identically calcined but is not first subjected to a precalcination heat treatment. Preferably, the needle coke produced by the method of the invention is additionally superior to comparable, conventionally prepared needle cokes in that the needle coke produced by the method of the invention has a higher bulk density and has a lower CTE of its graphitized product.

Although the foregoing description of the preferred embodiment assumes the use of a declining bed heater is a continuous process, it is understood that the invention is not limited thereto. Other heating equipment can be adapted to the invention, and the invention can be practiced as a batch process.

The invention can be further understood by considering the following specific examples which are illustrative of specific modes of practicing the invention and are not intended as limiting the scope of the appended claims.

EXAMPLE 1

Green needle coke containing about 10 weight percent water (dry basis) is crushed and screened to yield particles having diameters less than about 4 inches. About 440 tons per day of these coke particles are transferred at ambient conditions into hopper chamber 20 of precalciner 16. The particles form a gravitating coke bed which slides down declined bed support 24 in a substantially "plug flow" manner.

About 150,000 pounds per hour of drying gas comprising about 65.5 weight percent nitrogen, about 15 weight percent carbon dioxide, about 19 weight percent steam and about 0.5 weight percent oxygen is heated to about 430° F. and is caused to flow through the coke bed within drying section 32. The contact of the gas with the coke raises the coke bed temperature to about 350° F. in about 0.5 hours, and thereby dries the coke particles to about 0.5 weight percent water (dry basis). The pressure within drying section 32 is maintained at about −0.5 inches of water (gage).

About 82,000 pounds per hour of heat treating gas comprising about 72.5 weight percent nitrogen, 16 weight percent carbon dioxide, 11 weight percent steam and about 0.5 weight percent oxygen is heated to about 1,200° F. and is caused to flow through the coke bed within heat treating section 34. The contact of the gas with the coke raises the coke bed temperature to about 1,000° F. in about 0.5 hours and to an average maximum temperature of about 1,050° F. in about 1.1 hours. The pressure within heat treating section 34 is maintained at about −0.7 inches of water (gage).

The coke particles are removed from precalciner 16 and immediately transferred to calciner 52. Coke particles removed from precalciner 16 are markedly less friable than they were prior to their being heat treated within precalciner 16.

In calciner 52, the coke particles are calcined at a temperature of about 2,600° F. After calcination, the bulk density of the coke and the CTE of the graphitized coke are characteristic of that for premium grade needle coke suitable for base stock in the manufacture of heavy duty graphite electrodes.

EXAMPLE 2

Sixteen separate experiments are performed to test the effects of variations in temperature, residence time and the oxygen content of the heat treating gas during the heat treatment of green needle coke. Each experiment is performed in substantially the same manner: from a single lot of green needle coke, about 2,800 grams of 4 inch and smaller particles are suspended on a wire screen within a metal box. The metal box is placed within a Lindberg muffle furnace. A substantially inert gas is caused to flow into the box from an external source via tubing which terminates in a perforated section located immediately below the screen The inert gas displaces essentially all of the air within the metal box. The coke is then rapidly heated to a preselected temperature and maintained at that temperature for a preselected time period. The coke is then removed from the muffle furnace, cooled and tested for friability via ASTM test method D 409-51. The results are summarized in TABLE 2.

TABLE 2

| Experiment (Run #) | Gaseous Atmosphere (vol. % $O_2$) | Precalciner Temperature (°F.) | Precalciner Residence Time (hours) | Green Coke Friability (HGI) |
|---|---|---|---|---|
| Untreated green coke | — | — | — | 137 |
| 1* | 0 | 850 | 0.40 | 123 |
| 2* | 0 | 900 | 0.41 | 109 |
| 3 | 2 | 900 | 2.45 | 74 |
| 4 | 0 | 900 | 4.12 | 99 |
| 5 | 2 | 900 | 4.35 | 71 |
| 6 | 2 | 900 | 8.53 | 76 |
| 7 | 2 | 950 | 2.74 | 52 |
| 8 | 2 | 950 | 4.33 | 57 |
| 9 | 0 | 950 | 4.45 | 67 |
| 10 | 2 | 950 | 6.76 | 48 |
| 11 | 0 | 1,000 | 1.93 | 42 |
| 12 | 2 | 1,000 | 2.21 | 51 |
| 13 | 0 | 1,000 | 2.33 | 62 |
| 14 | 2 | 1,100 | 0.65 | 57 |
| 15 | 0 | 1,100 | 0.82 | 57 |
| 16 | 2 | 1,100 | 1.53 | 58 |

*Experimental runs 1 and 2 were performed with 1,800 grams of coke rather than with 2,800 grams.

From TABLE 2 it can be seen that the method of the invention markedly reduces the friability of green needle coke, especially when the coke is heated at temperatures between about 950° F. and about 1,100° F.

EXAMPLE 3

Three separate experiments are performed to test the effects of variations in precalcination heat treatment temperature and residence time on the bulk density of calcined needle coke product and on the CTE of graphitized coke product. Each experiment is performed in substantially the same manner: from a single lot of green needle coke, about 1,400 grams are placed in a graphite crucible. The crucible is placed in a preheated Cress electric kiln, rapidly heated to a preselected temperature, and maintained at that temperature for a preselected time period in an inert atmosphere. Without cooling, the crucible is then transferred to a preheated calcining oven and calcined to about 2,550° F. After calcination, the bulk density of the resultant needle coke product is measured and compared to the bulk density of a control sample which is prepared by calcining identical green needle coke in an identical manner but without a precalcination heat treatment. Also, a portion of the needle coke product is molded into a rod-like shape, graphitized and then analyzed for CTE. The results are compared to the CTE of an identically shaped and graphitized portion of the control sample. All results are summarized in TABLE 3.

TABLE 3

| Experiment (Run #) | Precalcination Temperature (°F.) | Precalcination Residence Time (hours) | CTE of Graphitized Product* ($10^{-7}$/°C.) | Product Bulk Density (g/ml) |
|---|---|---|---|---|
| Control | — | — | 2.8 | .825 |
| 1 | 950 | 4.25 | 1.8 | .856 |
| 2 | 1,000 | 1.23 | 3.2 | .777 |
| 3 | 1,100 | 1.12 | 3.6 | .799 |

*Measured over temperature range 25° to 125° C.

From TABLE 3 it can be seen that needle coke prepared by the method of the invention continues to retain properties of premium-grade needle coke (high bulk density and low graphite CTE). It can further be seen that when needle coke is prepared in accordance with the most preferred time-temperature profiles (Run #1), the bulk density and graphite CTE of the needle coke product is improved over the bulk density and graphite CTE of coke prepared without precalcination heat treatment.

Although particular embodiments of the invention have been described, including a preferred embodiment, it is evident that many alterations, modifications and variations of the invention will appear to those skilled in the art. It is intended that the invention embrace all such alternatives, modifications and variations as fall within the spirit and scope of the appended claims.

Having now described the invention, we claim:

1. A method for producing calcined needle coke from green needle coke having a Hardgrove Grindability Index above about 90 comprising:

(a) heating said green needle coke at temperatures between about 875° F. and about 1200° F. for a time between about 10 minutes and about 24 hours, said time being sufficient to effect a reduction in the friability of said green needle coke as determined by a decrease in said Hardgrove Grindability Index; and (b) without first allowing the temperature of the heated green needle coke to cool below about 500° F., calcining the heated green needle coke obtained from step (a) at calcination temperatures above about 2000° F.

2. The method defined in claim 1 wherein said green needle coke is heated in step (a) to an average maximum temperature between about 875° F. and about 1,200° F. such that:

$$0.4 < \left( \frac{t1}{6.0} + \frac{t2}{3.5} + \frac{t3}{0.8} + \frac{t4}{0.5} + \frac{t5}{0.3} \right) < 2.5$$

where t1 is the number of hours that said green needle coke is maintained at temperatures between about 875° F. and about 925° F., t2 is the number of hours (if any) that said green needle coke is maintained at temperatures between about 925° F. and about 975° F., t3 is the number of hours (if any) that said green needle coke is maintained at temperatures between about 975° F. and about 1,025° F., t4 is the number of hours (if any) that said green needle coke is maintained at temperatures between about 1,025° F. and about 1,100° F. and t5 is the number of hours (if any) that said green needle coke is maintained at temperatures between about 1,100° F. and about 1,200° F.

3. The method defined in claim 1 wherein said green needle coke is heated in step (a) to an average maximum temperature of between about 875° F. and about 925° F. such that said green needle coke is maintained at temperatures within about 50° F. of said average maximum temperature for between about 3 and about 24 hours.

4. The method defined in claim 1 wherein said green needle coke is heated in step (a) to an average maximum temperature of between about 925° F. and about 975° F. such that said green needle coke is maintained at temperatures within about 50° F. of said average maximum temperature for between about 1 and about 6 hours.

5. The method defined in claim 1 wherein said green needle coke is heated in step (a) to an average maximum temperature of between about 975° F. and about 1,025° F. such that said green needle coke is maintained at temperatures within about 50° F. of said average maximum temperature for between about 0.5 and about 4 hours.

6. The method defined in claim 1 wherein said green needle coke is heated in step (a) to an average maximum temperature of between about 1,025° F. and about 1,100° F. such that said green needle coke is maintained at temperatures within about 50° F. of said average maximum temperature for between about 0.3 and about 3 hours.

7. The method defined in claim 1 wherein said green needle coke is heated in step (a) to an average maximum temperature of between about 1,100° F. and about 1,200° F. such that said green needle coke is maintained at temperatures within about 50° F. of said average maximum temperature for between about 0.2 and about 1.0 hours.

8. The method defined in claim 1 wherein the heating of the green needle coke in step (a) is accomplished in a declined plane-type heater.

9. The method defined in claim 1 wherein said green needle coke is dried to a water content less than about 5.0 weight percent (dry basis) before being heated in step (a).

10. The method defined in claim 1 wherein the needle coke obtained from step (a) has a Hardgrove Grindability Index value less than about 70.

11. The method defined in claim 1 wherein said green needle coke has a Hardgrove Grindability Index above about 120.

12. The method defined in claim 1 wherein said green needle coke has a Hardgrove Grindability Index value above about 120 and the needle coke obtained from step (a) has a Hardgrove Grindability Index value less than about 70.

13. The method defined in claim 1 wherein said green needle coke contains less than about 1 weight percent sulfur and is manufactured from an aromatic mineral oil feedstock having an API gravity between about −6° and +15°, boiling predominantly above about 600° F. and containing about 6.5 to 9 weight percent hydrogen and more than about 0.7 weight percent sulfur by a process comprising:

(1) fractionally distilling said feedstock so as to separate a major overhead fraction from a minor bottoms fraction, any asphaltenes present in said feedstock being concentrated in said bottoms fraction;

(2) subjecting said overhead fraction to catalytic hydrofining at a temperature correlated with hydrogen pressure and space velocity so as to effect at least about 50 percent desulfurization of said fraction without raising the hydrogen content of the 500° F.+ hydrofiner effluent above about 10.5 weight percent;

(3) recovering from step (2) a heavy hydrofined fraction boiling predominantly above 600° F. and blending the same with at least a portion of said minor bottoms fraction so as to form a coking feedstock containing less than about 5 weight percent asphaltenes; and (4) subjecting said coking feedstock to delayed thermal coking at a temperature correlated with pressure so as to give a needle coke and a coker distillate.

14. The method defined in claim 1 wherein the needle coke obtained from step (b) has, when graphitized, a lower coefficient of thermal expansion than the identically graphitized product of needle coke prepared by taking identical green needle coke and immediately calcining it by a procedure identical to that employed in step (b) without first heating said green needle coke in accordance with the procedure of step (a).

15. A method for producing calcined needle coke from green needle coke having a Hardgrove Grindability Index above about 90 comprising:

(a) drying said green needle coke to an absorbed water content which is less than about 5.0 weight percent (dry basis);

(b) heating said dried green needle coke obtained from step (a) to an average maximum temperature between about 875° F. and about 1200° F. such that:

$$0.4 < \left( \frac{t1}{6.0} + \frac{t2}{3.5} + \frac{t3}{0.8} + \frac{t4}{0.5} + \frac{t5}{0.3} \right) < 2.5$$

where t1 is the number of hours that said dried green needle coke is maintained at temperatures between about 875° F. and about 925° F., t2 is the number of hours (if any) that said dried green needle coke is maintained at temperatures between about 925° F. and about 975° F., t3 is the number of hours (if any) that said dried green needle coke is maintained at temperatures between about 975° F. and about 1025° F., t4 is the number of hours (if any) that said dried green needle coke is maintained at temperatures between about 1025° F. and about 1100° F. and t5 is the number of hours (if any) that said dried green needle coke is maintained at temperatures between about 1100° F. and about 1200° F. and wherein said dried green needle coke is heated for total time sufficient to effect a rdduction in the friability of said green needle coke as determined by a decrease in said Hardgrove Grindability Index; and (c) without allowing the temperature of the heated green needle coke to cool below about 500° F., calcining the heated green needle coke obtained from step (b) at calcination temperatures above about 2000° F.

16. The method defined in claim 1 wherein said green needle coke is heated in step (a) to an average maximum temperature of between about 875° F. and about 925° F. such that said green needle coke is maintained at temperatures within about 50° F. of said average maximum temperature for between about 4 and about 8 hours.

17. The method defined in claim 1 wherein said green needle coke is heated in step (a) to an average maximum temperature of between about 925° F. and about 975° F. such that said green needle coke is maintained at temperatures within about 50° F. of said average maximum temperature for between about 1.2 and about 5 hours.

18. The method defined in claim 1 wherein said green needle coke is heated in step (a) to an average maximum temperature of between about 975° F. and about 1,025° F. such that said green needle coke is maintained at temperatures within about 50° F. of said average maximum temperature for between about 0.6 and about 2 hours.

19. The method defined in claim 1 wherein said green needle coke is heated in step (a) to an average maximum temperature of between about 1,025° F. and about 1,100° F. such that said green needle coke is maintained at temperatures within about 50° F. of said average maximum temperature for between about 0.4 and about 2 hours.

20. The method defined in claim 1 wherein said green needle coke is heated in step (a) to an average maximum temperature of between about 1,100° F. and about 1,200° F. such that said green needle coke is maintained at temperatures within about 50° F. of said average maximum temperature for between about 0.2 and about 0.8 hours.

21. The method defined in claim 15 wherein the heating of the dried green needle coke in step (b) is accomplished in a declined plane-type heater.

22. The method defined in claim 15 wherein said green needle coke has a Hardgrove Grindability Index value above about 120 and the needle coke obtained from step (b) has a Hardgrove Grindability Index value less than about 70.

23. The method defined in claim 15 wherein said green needle coke contains less than about 1 weight percent sulfur and is manufactured from an aromatic mineral oil feedstock having an API gravity between about −6° and +15°, boiling predominantly above about 600° F. and containing about 6.5 to 9 weight percent hydrogen and more than about 0.7 weight percent sulfur, by a process comprising:

(1) fractionally distilling said feedstock so as to separate a major overhead fraction from a minor bottoms fraction, any asphaltenes present in said feedstock being concentrated in said bottoms fraction;

(2) subjecting said overhead fraction to catalytic hydrofining at a temperature correlated with hydrogen pressure and space velocity so as to effect at least about 50 percent desulfurization of said fraction without raising the hydrogen content of the 500° F.+ hydrofiner effluent above about 10.5 weight percent;

(3) recovering from step (2) a heavy hydrofined fraction boiling predominantly about 600° F. and blending the same with at least a portion of said minor bottoms fraction so as to form a coking feedstock containing less than about 5 weight percent asphaltenes; and (4) subjecting said coking feedstock to delayed thermal coking at a temperature correlated with pressure so as to give a needle coke and a coker distillate.

24. The method defined in claim 15 wherein the needle coke obtained from step (c) has, when graphitized, a lower coefficient of thermal expansion than the identically graphitized product of needle coke prepared by taking identical green neddle coke and immediately calcining it by a procedure identical to that employed in step (c) without first drying and heating said green needle coke in accordance with the procedures of steps (a) and (b).

25. The method defined in claim 15 wherein the needle coke obtained from step (c) has a greater bulk density than needle coke prepared by taking the same green neddle coke and immediately calcincing it by a procedure identical to that employed in step (c) without first drying and heating said green needle coke in accordance with the procedures of steps (a) and (b).

26. A method for producing calcined needle coke from green needle coke having a Hardgrove Grindability Index above about 90 comprising:

(a) heating said green needle coke by contact with hot gases in the drying section of a declined bed-type heater so as to dry said green needle coke to an absorbed water content which is less than about 2.0 weight percent (dry basis);

(b) heating said dried green needle coke obtained from step (a) by contact with hot gases in the heat treating section of said declined bed-type heater to an average maximum temperature between about 975° F. and about 1025° F. such that said dried coke is heated to within about 50° F. of said average maximum temperature within about 0.5 hours and such that said dried coke is maintained within about 50° F. of said average maximum temperature for a time between about 0.6 and about 1.1 hours, said time being sufficient to effect a reduction in the friability of said green needle coke as determined by a decrease in said Hardgrove Grindability Index; and (c) without allowing the temperature of the heated green needle coke to cool below about 500° F., calcining said heated green neddle coke obtained from step (b) at calcination temperatures above about 2000° F.

27. The method defined in claim 26 wherein said green needle coke contains less than about 1 weight percent sulfur and is manufactured from an aromatic mineral oil feedstock having an API gravity between about −6° and +15°, boiling predominantly above about 600° F. and containing about 6.5 to 9 weight percent hydrogen and more than about 0.7 weight percent sulfur, by a process comprising:

(1) fractionally distilling said feedstock so as to separate a major overhead fraction from a minor bottoms fraction, any asphaltenes present in said feedstock being concentrated in said bottoms fraction;

(2) subjecting said overhead fraction to catalytic hydrofining at a temperature correlated with hydrogen pressure and space velocity so as to effect at least about 50 percent desulfurization of said fraction without raising the hydrogen content of the 500° F.+ hydrofiner effluent above about 10.5 weight percent;

(3) recovering from step (2) a heavy hydrofined fraction boiling predominantly above 600° F. and blending the same with at least a portion of said minor bottoms fraction so as to form a coking feedstock containing less than about 5 weight percent asphaltenes; and (4) subjecting said coking feedstock to delayed thermal coking at a temperature correlated with pressure so as to give a needle coke and a coker distillate.

28. The method defined in claim 26 wherein the neddle coke obtained from step (c) has a greater bulk density than needle coke prepared by taking identical green needle coke and immediately calcining it by a procedure identical to that employed in step (c) without first heating said green needle coke in accordance with the procedures of steps (a) and (b).

29. The method defined in claim 26 wherein the needle coke product obtained from step (c) has, when graphitized, a lower coefficient of thermal expansion than the identically graphitized product of needle coke prepared by taking identical green needle coke and immediately calcining it by a procedure identical to that employed in step (c) without first heating said green needle coke in accordance with the procedures of steps (a) and (b).

30. The method defined in claim 26 wherein said green needle coke has a Hardgrove Grindability Index above about 120.

31. The method defined in claim 1 wherein said green needle coke is heated at temperatures between about 950° F. and about 1050° F.

32. The method defined in claim 15 wherein said green needle coke is dried in step (a) at temperatures between about 250° F. and about 450° F.

33. The method defined in claim 26 wherein said green needle coke is heated in step (a) at temperatures between about 250° F. and about 450° F.

34. A method for producing calcined needle coke from green neddle coke having a Hardgrove Grindability Index above about 90 comprising:

(a) heating said green needle coke at temperatures between about 875° F. and about 1200° F. for a time sufficient to effect a reduction in the friability of said green needle coke as determined by a decrease in said Hardgrove Grindability Index; and (b) without first allowing the temperature of said heated green needle coke to cool below about 500° F., calcining said heated green needle coke obtained from step (a) at calcination temperatures above about 2000° F.

* * * * *